United States Patent [19]

Mummert

[11] 4,274,399

[45] Jun. 23, 1981

[54] THERAPEUTIC APPLIANCE FOR FLEXING JOINTS

[75] Inventor: Thomas A. Mummert, Perrysburg, Ohio

[73] Assignee: Jobst Institute, Inc., Toledo, Ohio

[21] Appl. No.: 116,489

[22] Filed: Jan. 29, 1980

[51] Int. Cl.[3] ..... A61H 1/02

[52] U.S. Cl. ..... 128/26; 128/DIG. 20

[58] Field of Search ..... 128/26, 24 R, 77, 87 R, 128/DIG. 20

[56] References Cited

U.S. PATENT DOCUMENTS

| | | | |
|---|---|---|---|
| 2,880,721 | 4/1959 | Corcoran | 128/26 UX |
| 3,457,912 | 7/1969 | Clark et al. | 128/26 |
| 3,581,740 | 6/1971 | Sherbourne | 128/77 |
| 3,937,215 | 2/1976 | Barthlome | 128/26 |

*Primary Examiner*—John D. Yasko

*Attorney, Agent, or Firm*—Wilson, Fraser, Barker & Clemens

[57] ABSTRACT

An appliance for flexing joints which is driven by fluid pressure. A fluid tight bladder is coupled to an inextensible flexible member to be mounted against a body portion spanning the joint to be flexed. The bladder is arranged in sinuous convolutions extending longitudinally of the member and across the region overlying the joint with its convex portion of each convolution secured to the member at a point longitudinally spaced from adjacent points of securement of adjacent convex portions. Upon admission of fluid under pressure, the bladder walls are forced outwardly to bear upon each other and impose a compressive bending moment on the flexible member at the points of securement. A hand mit is shown with separate bladder convolutions on the palm and back such that admission of pressurized fluid to the back bladder forces a hand in the mit into a fist and the admission of fluid to the palm bladder and release of the fluid in the back bladder opens the fist. Pressure and temperature treatment means are included together with control systems for cyclic treatment.

21 Claims, 13 Drawing Figures

THERAPEUTIC APPLIANCE FOR FLEXING JOINTS

BACKGROUND OF THE INVENTION

This invention relates to an exercising appliance for therapeutic flexing of joints which have lost mobility due to an illness or injury or for the limbering of joints to enhance their utilization, as in sports or other physical activities. While the principles of operation and combination of elements of this invention are applicable to various joints of an animal body, the following disclosure primarily will deal with a hand exerciser for flexing the digits, either individually, or in unison, with or without flexing of the hand and/or the wrist.

Heretofore, hand and finger exercisers have been proposed. Rotating reciprocating and oscillating mechanisms are typified by the FINGER EXERCISER of Walls U.S. Pat. No. 1,707,151; the CONTROL AND OPERATING MEANS FOR PARALYZED HANDS of Robinson et al, U.S. Pat. No. 2,553,277; the SURGICAL CAST-SUPPORTED FINGER EXERCISER of DeMona U.S. Pat. No. 2,353,129, and the MECHANICAL HAND of Daniels et al U.S. Pat. No. 3,020,908. Each of these mechanisms is made up of rigid inflexible and cumbersome mechanical linkages. Cable drives have also been employed for hand exercisers as in the ELECTRICALLY DRIVEN HAND EXERCISER of Ketchum, U.S. Pat. No. 3,756,222; and the HAND EXERCISING DEVICE of Clark et al, U.S. Pat. No. 3,457,912, this latter patent utilizing fluid pressure as the driving means. These types of devices are generally mounted in a fixed position for treatment and are complex, cumbersome and expensive such that they are not readily available to the patient other than at a treatment station such as a hospital or professional office. Fluid operated therapeutic exercisers of flexible material wherein air or other fluids are admitted to bladders to cause flexure of the appliance and the body elements to which it is applied, are shown in Canadian Pat. No. 735,700 to Vian for THERAPEUTIC GLOVE and U.S. Pat. Nos. 3,581,740 to Sherbourne for INFLATABLE DEVICE FOR ARTHRITIC THERAPY and 3,937,215 to Barthlome for THERAPEUTIC HAND EXERCISER. Each of these appliances utilizes a bladder which is inflated to extend the bladder and exert tension on the body portions.

SUMMARY OF THE INVENTION

The exercising appliance of the present invention develops compressive forces tending to flex an inextensible, flexible member which is maintained against an animal body portion including a joint to flex that joint. A plurality of adjacent flexible walled sections or compartments are secured to the member to be flexed such that upon their distension by the admission of a fluid under pressure, they impose pressure on the sidewalls of adjacent sections or compartments, thereby developing a compressive bending moment on the member to which the sections or compartments are secured. In a preferred embodiment, the inextensible, flexible member can be in the form of a tube fitted over the animal body portion to be treated, having a bladder, of a length exceeding the length of the portion of the tube which is to be flexed, secured at points spaced longitudinally of the tube in a sinusoidal convoluted form with the convex portion of each convolute secured to the tube and the intervening portions of the convolute free of the tube.

A hand exerciser is provided with at least two bladders which work in opposition to reverse the flexure of the hand cyclically in an exercise regime. Independent means to pass fluid between the exterior and interior of each bladder are provided so that fluid can be released from one bladder while it is applied under pressure to the opposite bladder.

Additional features of the invention include individual digit flexing elements cooperating with a hand exerciser or other individual digit exercisers and utilizing the bladders imposing compressive bending moments on the outside of the joint enclosure in which bending forces are sought to be developed. The appliance is also suitable for the application of controlled pressure or thermal conditions to the body portion subject to treatment by virtue of an enclosing chamber for the flexing elements. An outer enclosure is provided with means to apply fluid to the region around the body portion enclosure and its flexing bladders so that the temperature and/or pressure of the fluid is applied through those elements to the body portion. The air or fluid conduits to the flexing bladders are passed through the chamber between the outer enclosure and the flexing bladders.

A source of pressurized fluid for the flexing bladders can be arranged with a suitable reservoir and valving so that the fluid can be selectively admitted to and released from the bladder or bladders. Such a fluid supply can be timed, either with a fixed or adjustable time interval for the several conditions. It can be provided with a pressure regulating means which can be adjustable.

Controlled pressure and thermal conditions applied to the body portion to be treated can also be cycled as to pressure and/or temperature of the fluids introduced into the enclosing chamber. These cycles can be correlated with the flexure regime, as by a hand treatment which imposes pressure on the hand through pressurization of the enclosing chamber while the palm is opened by pressure in the palm bladder and which relieves the pressure on the hand while the hand is closed into a fist by pressure on the back bladder. Alternatively, a long cycle of pressure applied through pressurization of the outer chamber can be imposed for a multiplicity of openings and closings of the fist. The fluid in the outer chamber can be heated or cooled in cyclic fashion for thermal treatments of varying duration.

DESCRIPTION OF THE PREFERRED EMBODIMENTS

Figure 1:
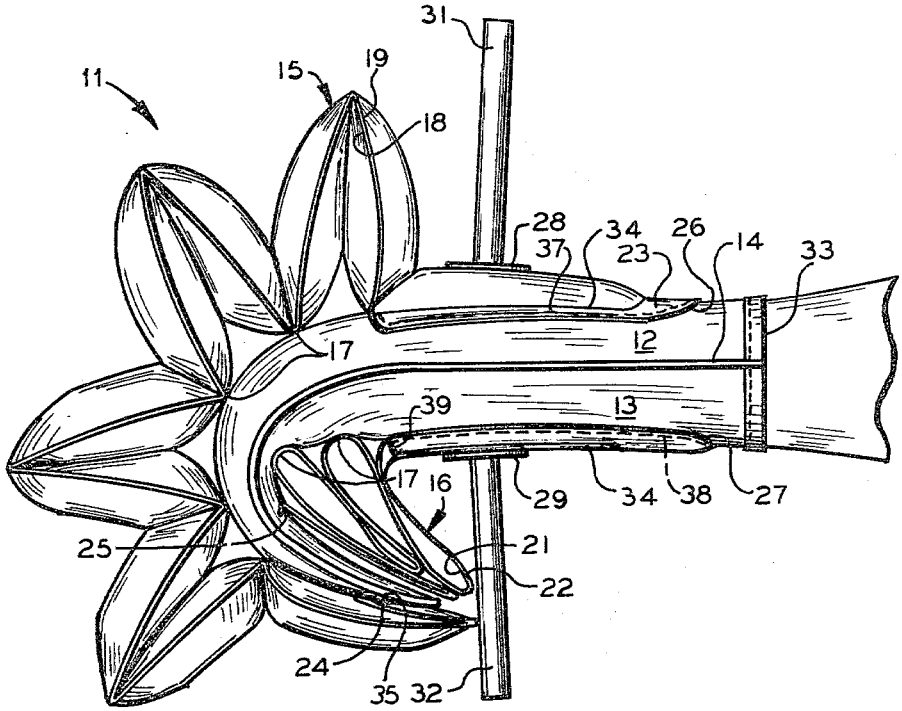
FIG. 1 is a side elevational view of a hand exerciser according to this invention, showing the appliance mounted on a hand and the back bladder pressurized to close the hand into a fist.

The preferred embodiment of FIG. 1 is a therapeutic appliance for flexing a human hand. It comprises a mit 11 made up of a suitable non-extensible and flexible sheet material as a pair of superposed panels 12 and 13 sealed at 14 along their edges to form an envelope suitable for the reception of the entire hand. In the illustrated embodiment, the panels are formed of sheet material which can be clear urethane sheet, providing transparency for observation of the hand under treatment, although alternative sheet materials can be used such as nylon cloth which, when it is to provide a barrier to the passage of a fluid, can be suitably impregnated with a sealant such as neoprene.

Figure 4:
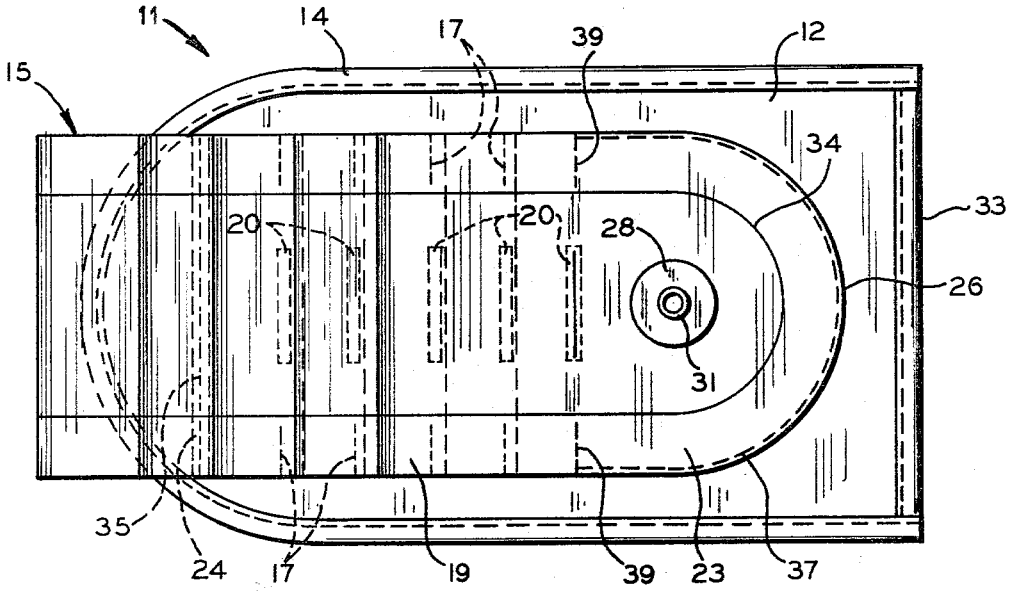
FIG. 4 is a plan view of the hand exerciser of FIG. 3.

Flexure of the mit is achieved by pressurizing of bladders 15 and 16, secured on the outer faces of the marginal regions of the mit 11 at securement regions 17, as illustrated in FIG. 4. Each of bladders 15 and 16 is formed of flexible, fluid impervious material advantageously, of the material of the mit to match the mit material compatibly. Where the mit is transparent, the bladders can also be transparent to permit inspection of the hand while under treatment.

As shown in FIG. 1, with pressure relieved in palm bladder 16 and the back bladder 15 filled with pressurized fluid, the outer walls of adjacent convolutions of the bladder press upon each other as do the inner walls of each convolution. This generates a bending moment in the member to which the convolutions are secured by tending to push the regions of securement of the bladder between each convolution around an arc centered generally on the fist of the patient.

Figure 2:
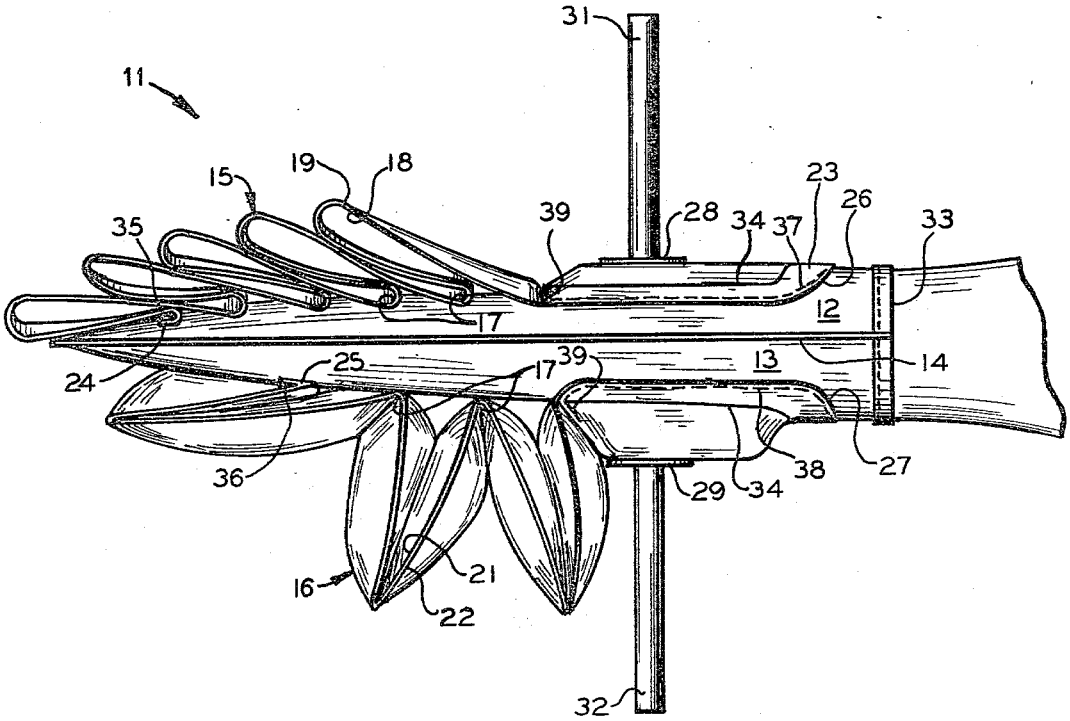
FIG. 2 is a side elevational view of the hand exerciser of FIG. 1 with the back bladder flaccid and the palm bladder pressurized to open the fist.

An opposite bending moment is developed as shown in FIG. 2 by relieving the pressure in back bladder 15 and introducing pressurized fluid into palm bladder 16. Again, the walls of the convolutions of the bladder bear upon and press each other apart as the inner walls of each individual convolution and the outer walls of adjacent convolutions. The fist is opened and the hand and fingers straightened in this condition of the mit appliance.

Figure 3:
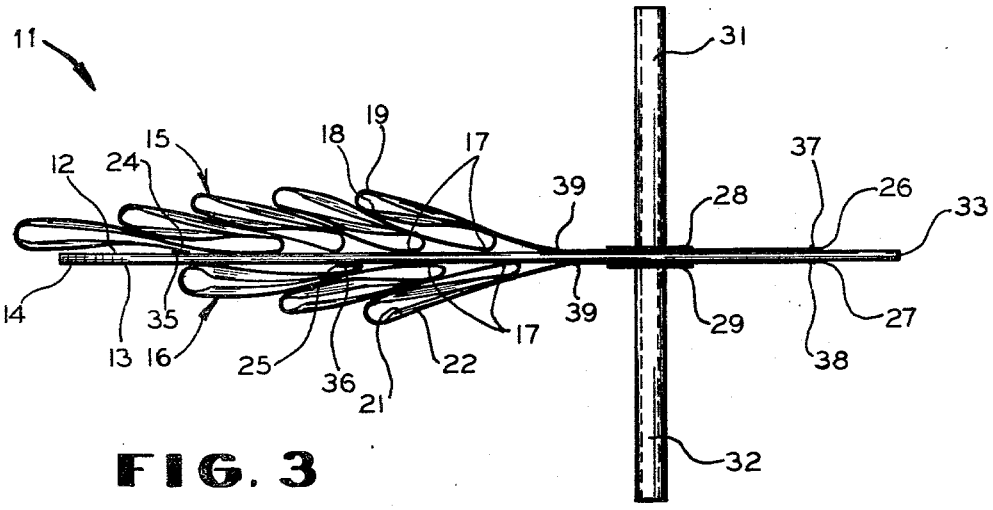
FIG. 3 is a side elevational view of the hand exerciser of FIG. 1 when removed from the patient's hand and with the bladders flaccid.
Figure 5:
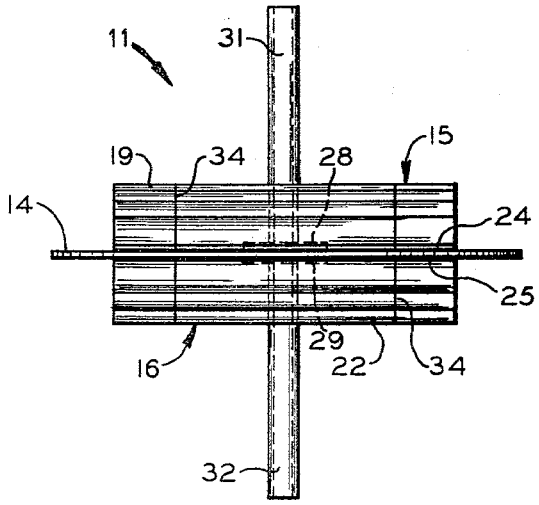
FIG. 5 is an end view of the hand exerciser of FIG. 3.

Bladders 15 and 16 are each formed as tubes, typically from flat inner and outer panels 18 and 19 for bladder 15 and 21 and 22 for bladder 16, sealed along their margins 23, as best seen in FIGS. 3 through 5. Single elongate panels of material can be folded at their longitudinal midpoints as at 24 and 25, to form one end of each bladder and can be of generally semicircular form at their opposite ends 26 and 27 to conform to the circular flange couplings 28 and 29 of the fluid conduit stems 31 and 32 by means of which fluid is admitted to the bladder interiors. The semicircular end 26 and 27 of the bladders also facilitate the confirmation of the mit around the wrist of the wearer as it extends from the mit open end 33.

Figure 10:
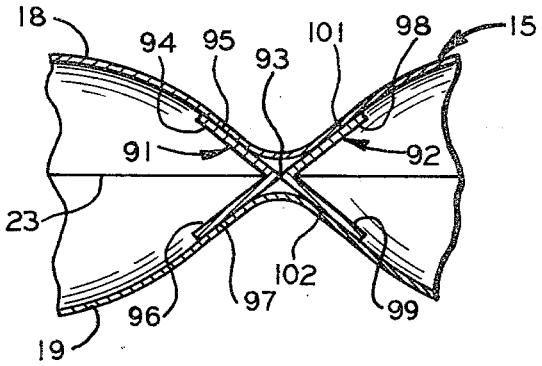
FIG. 10 is a sectioned side elevational view of a portion of a typical segmenting means for forming chambers in a bladder as employed in this invention with the bladder free of an appliance and inflated to illustrate the structure.

Panel faces of back bladder 15 are sealed along their margins as in the region 23 extending longitudinally of the panels 18 and 19 and around their semicircular ends 26. The palm bladder 16 is similarly sealed. Bladders 15 and 16 are secured to the outer faces of the mit back panel 12 and palm panel 13 respectively at their ends as by flexible cemented or sewn and sealed regions 35 and 36 at the folds of ends 24 and 25 and 37 and 38 at the semicircular ends. Compartments are formed within each bladder by constraining their walls against ballooning along lines extending transversely of the length of the bladder and which are spaced along the length. One such securing means can be an adhesive bond between the interior faces of the superposed panels, as at the bond lines 20 transverse of panels 18 and 19 of bladder 15. Typically, where panels 18 and 19 are of a material which can be fused thermally, the bond lines 20 can be formed thermally. An alternative form of cemented and sewn bond for compartmenting bladders is shown in FIG. 10.

Bond lines 20 are located at the troughs of the convolutions in the bladder as mounted on the joint embracing element, mit 11 in the example, and are therefor spaced along the bladder a greater distance than the spacing of the points on the element at which the bladder is secured thereto. They extend only partially across the interior of the bladder so that the chambers they form in the bladder are in fluid flow communication with each other. In the illustration, bond lines 20 do not extend to the longitudinal marginal seals between panels 18 and 19 of bladder 15.

Marginal regions of securement 17 for the bladders are located along the longitudinal edges of the bladders and are secured by sewing or bonding, on the mit, outer faces in the region coincident with bladder edge seams 23 in elongate regions extending transverse of the longitudinal axis of the mit 11 in pairs on the respective faces which are in transverse alignment and are aligned with the bond lines 20 to form a sinuous bladder on each of the faces. As shown in FIGS. 3 and 4, the back bladder 15 is formed in five convolutions by five bond lines 20, four of which are aligned with four pairs of securement regions 17, intermediate the end regions of securement 35 and 37. A pair of transverse regions of securement 39 generally perpendicular to the ends of, and continuous with region 37, are aligned with the fifth bond line 20 to form one end of the series of convolutions and the region 35 forms the opposite end such that all of regions 39, 17 and 35 have their longitudinal dimensions generally parallel.

Spacing of the convolutions longitudinal of the mit at their regions of securement, advantageously approximates the spacing of the finger joints of the hand to be treated in the mit. The spacing of the securement regions 39, 17 and 35 along each longitudinal margin of the bladder can be about six times the spacing of those regions on the mit so that the height of the convolutions can be about three times their pitch.

The palm bladder 16 is secured in its seamed regions to the outer face of palm panel 13 in the same manner that back bladder 15 is secured to back panel 12. It has been found that fewer convolutions are required on the palm face than on the back face and that the regions of securement for those convolutions can be offset toward the open end of the mit from those for the back face. Thus, as shown in FIGS. 3 and 4, the end 35 is secured at region 36 located in general registry with the space between the regions 17 on back panel 12 forming the center of the sinuous back bladder 15. The securement regions 17 of the palm bladder convolutions are located on palm panel 13 intermediate the area in registry with the securement regions on back panel 12, and the termination regions of securement 39 for the palm bladder are nearer the open end of the mit than are those corresponding regions for the back bladder.

In operation, the admission of pressurized fluid, such as air in a pneumatic system or water in a hydraulic system, distends the bladder causing the inner faces 18 of each convolution to press against each other and the outer faces 19 of adjacent convolutions to press against each other, thereby imposing a bending moment on the panel to which the convolutions are secured at regions 35, 17 and 39, or 36, 17 and 39. In a regime of treatment, the mit is placed on the hand of the patient, and pressurized fluid is alternately introduced into and expelled from bladders 15 and 16, typically with one bladder being filled or under compression while the other is empty. Operating intervals can be of the order of five seconds upward to several minutes with fluid pressures of about 80 m.m. of Hg. The intervals need not be uniform. That is, a pressurized interval can be longer or shorter than a depressurized interval and the back bladder can be pressurized a greater or lesser proportion of the time than the front bladder depending on the treatment desired.

Figure 7:
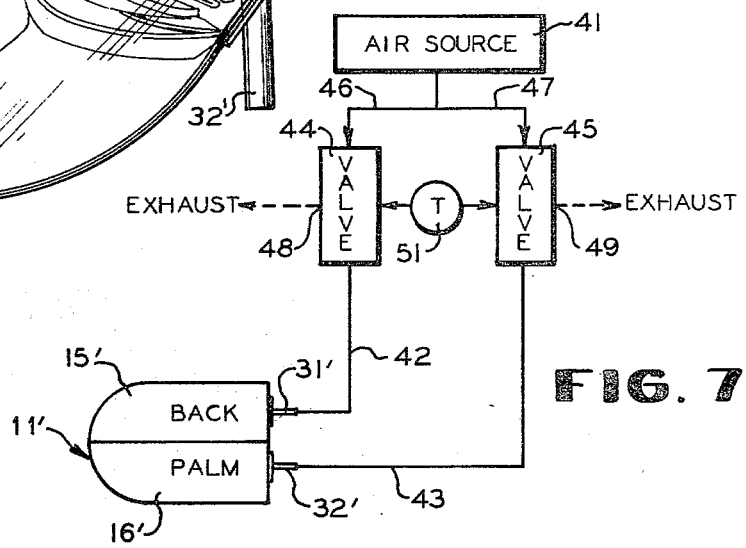
FIG. 7 is a schematic diagram of a control system for an appliance according to this invention for cyclic operation of the appliance.

FIG. 7 illustrates an elemental pneumatic system for a hand exerciser. Air from a suitable source 41 which may be regulated to a desired pressure or be provided with pressure adjusting means (not shown) is selectively admitted to the back bladder 15' or the palm bladder of the mit appliance 11 through conduits 42 or 43, respectively coupled to stem 31' for bladder 15', and stem 32' for bladder 16'. Suitable valves 44 and 45 have one port coupled respectively to conduits 42 and 43 and are each provided with an inlet port coupled to air source 41 through conduits 46 and 47, respectively, so that at one setting of those valves, the air source 41 supplies air to their output ports and conduits 42 and 43. Each of valves 44 and 45 also have an exhaust port 48 and 49 respectively shown vented to atmosphere so that at a second setting, they couple their output ports to their exhaust ports 48 and 49. A timer 51, which can be motor driven, controls valves 44 and 45.

In one arrangement, timer 51 can include cam actuators for the valves 44 and 45, arranged to set valve 44 to couple input 46 to output 42, thereby filling back bladder 15' and pressurizing it to the pressure of source 41, while valve 45 is set to cut off source conduit 47 and to couple output 43 to exhaust 49, thereby bleeding any air in palm bladder 16' to atmosphere. In another portion of the cycle of timer 51, valve 44 can be set to cut off source conduit 46 while output conduit 42 is bled to atmosphere by being coupled to exhaust port 48, and valve 45 can be set to couple source conduit 47 to output conduit 43, thereby inflating and pressurizing palm bladder 16'. It will be appreciated that dwell periods can be provided by timer 51 in which neither bladder is pressurized and that the inflation intervals for the back bladder 15' and palm bladder 16' can be of selected lengths which can be equal or unequal.

A hydraulic pressurizing system for a hand exerciser can be of the same general form as that shown in FIG. 7, provided a suitable discharge is provided for the valve exhausts 48 and 49. Typically, a closed system might be employed wherein the fluid source 41 includes a reservoir (not shown) into which the discharge from the exhaust ports 48 and 49 are fed.

Figure 6:
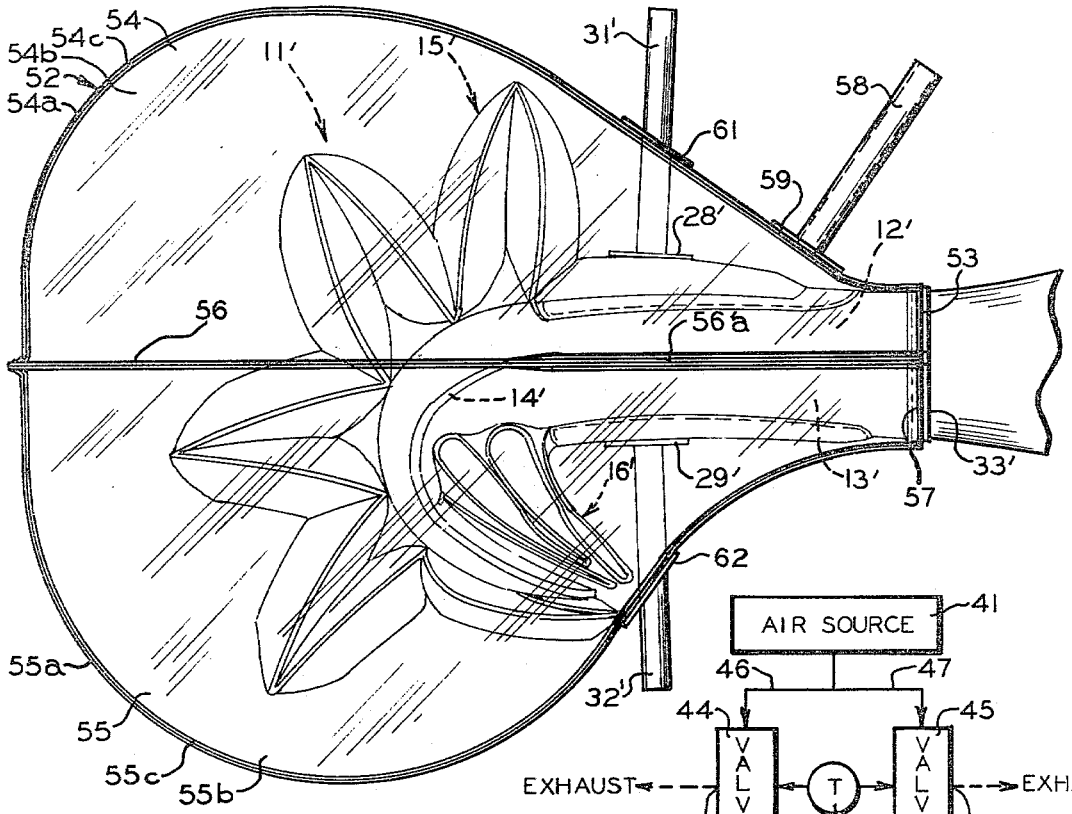
FIG. 6 is a side elevational view of a hand exerciser having an enclosing chamber for containment of a thermal and/or pressure treatment fluid.

Treatment techniques for the hands and wrists frequently include the combination of flexure of the joints and the application of pressure or controlled temperature to the region. An embodiment of an applicance providing means to apply a treatment fluid to the mit and thus to the hand and wrist is illustrated in FIG. 6. In this arrangement, the appliance of FIGS. 1–5 is modified by being enclosed in an outer envelope 52 having an opening 53 for admission of the hand and wrist of the patient. In other respects, the appliance has elements which correspond to those previously discussed and, where appropriate, primed reference characters of the previously applied reference characters will be employed.

Mit 11' is shown in the fist closing condition in FIG. 6 with its back bladder 15' filled and pressurized to produce a bending moment by the pressure of opposed inner panel portions of each convolution of the bladder on each other and the pressure of opposed outer panel portions of adjacent convolutions on each other. The palm bladder 16' is empty and, thus, flaccid. An envelope 52 of flexible, fluid, impervious and non-extensible sheet material, which may be clear urethane sheet if the appliance is, or at least its outer envelope, is to be transparent, or may be an opaque material such as neoprene impregnated nylon, forms an outer wall which cooperates with the inner wall formed by the mit 11' to form a fluid chamber within which the mit and its actuating bladders are free to flex between the fist forming condition of FIG. 1 and the hand extended condition of FIG. 2. In this configuration, the mit panels 12' and 13', and the seam 14' therebetween, should also be fluid impervious since they will form the inner walls of the fluid chamber 52.

Outer envelope walls of fluid chamber 52 can be formed of flat, flexible and relatively inextensible and thermally stable sheet stock. The non-flexing portions of the mit 11' should be secured to the envelope walls to inhibit the ejection of the mit from within the chamber 52 when it is subjected to fluid under pressure in a pressurized treatment of the hand. One form of envelope offering these features is made up of a rear section 54 and a palm section 55 joined along seam 56. Each section is made up of a face wall and side walls. Rear section comprises a face wall **54*a* and side walls 54*b* joined along seam 54*c* to accommodate the flat sheet material to the geometry of chamber 52. Palm section 55 similarly comprises face wall 55*a* and side walls 55*b* joined along seam 55*c*. Seam 56 joining sections 54 and 55 embraces the outer seam of mit 11' adjacent the non-flexing section of the mit in the region 56*a***.

The outer walls 54 and 55 of chamber 52 are sealed to the mit 11' at its opening 33', which coincides with the chamber opening 53 by means of a fluid impervious seam 57. Chamber 52 is filled and emptied by a stem 58 having a flange coupling 59 sealed to the stem 58 and to panel **54*a* and registering with an aperture, in panel 54*a*, to provide fluid communication between the interior and exterior of the chamber in the manner of bladder stems 31 and 32 of FIGS. 3 and 5. The admission of fluid under pressure into chamber 52 through stem 58 compresses the mit thereby imposing pressure on the hand under treatment in the mit, while permitting the flexing of the mit under the force of pressurized fluid in bladders 15' and 16'**.

Fluid communication to the mit flexing bladders 15' and 16' is by means of stems 31' and 32', respectively. These stems are passed through apertures in the panels, 54*a* for stem 31', and 55*a* for stem 32', in sealed relationship thereto, by coupling flanges 61 and 62 sealed to stems 31' and 32', a suitable distance from their flanges 28' and 29' for accommodating the extended chamber walls, and to panels 54*a* and 55*a*, respectively.

Figure 8:
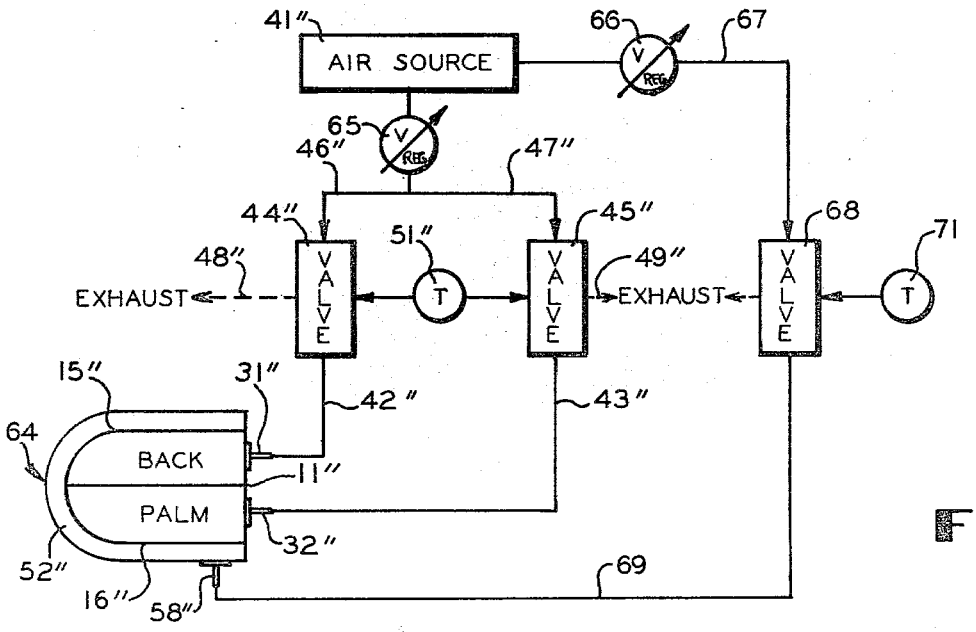
FIG. 8 is a schematic diagram of a system for flexure and pressure treatment including separate timing controls for flexure and pressure treatment.

Either pneumatic or hydraulic pressure can be imposed on mit 11' by a fluid in chamber 52. FIG. 8 illustrates a pneumatic pressure and flexing treatment system in which reference characters have been double primed for those elements corresponding to like elements of FIGS. 1 through 7. Appliance 64 includes a mit 11'' having a back bladder 15'' and a palm bladder 16'' enclosed by a pressure chamber 52''. The flexing section of the system corresponds to that of FIG. 7 in that it includes an air source 41'' of high pressure air coupled to supply conduits 46'' and 47'' to back bladder control valve 44'' and palm bladder control valve 45''. Control valves 44'' and 45'' each have an exhaust 48'' and 49'', and an output coupled to back conduit 42'' and palm conduit 43''. The control valves can be set to couple the air supply to the bladders or the bladders to the exhausts. A timer 51'' drives the valve actuator as described for FIG. 7.

Air supply 41'' is employed as a source for the flexing bladders and for the pressure chamber 52''. Since different pressures may be desired for the section actuating the flexing bladders than for the section pressurizing the chamber 52'', adjustable pressure regulators are shown in the conduits for those sections as regulator 65 for the bladder section and regulator 66 for the pressurizing section.

Pressurizing section includes a supply conduit 67 between air supply 41'' and valve 68 in which regulator 66 is located. Valve 68 has an input, output and exhaust port with conduit 67 coupled to the input and its valving functions arranged to couple the output to either the input or the exhaust. Valve output is coupled to pressure chamber 52'' by conduit 69 in fluid flow communication with stem 58''.

Pressure as indicated by the treatment to be accomplished can be applied with appliance 64. Valve 68 can be set to cut off all pressure, to maintain pressure continuously, or to apply pressure cyclically. A timer 71 controls the setting of valve 68 as by cams operating the valve actuator (not shown). Thus, pressure can be applied over intervals defined independently of the flexing intervals defined by timer 51''. One treatment involves pressure intervals and relief intervals which span several flexure cycles.

As in the case of the system of FIG. 7, the system of FIG. 8 can be wholly or partially hydraulically actuated provided a suitable exhaust conduit is coupled to the valves of the section employing liquid.

Another treatment aspect which can be accommodated with the appliance of this invention is a thermal treatment. This can be in the form of a heating or cooling of the joint region subject to flexure and can be with or without the imposition of pressure. Control of temperature at the appliance advantageously is accomplished by employing a liquid as the temperature control medium. Accordingly, a hydraulic system for flexure, pressure, and temperature control operating with an appliance of the form shown in FIG. 6, is shown in FIG. 9.

Where temperature control is desired, the material of the appliance must maintain its flexibility, non-expansibility, and fluid imperviousness at the temperatures to be imposed. The system illustrated employs fluid supply sections similar to those of FIG. 8 and thus discloses the withdrawal of the fluid from the appliance through the conduits which supply the appliance. It is to be recognized that in some applications it may be desirable to circulate the temperature controlled fluid through the appliance while maintaining the desired pressures on the sections. Circulation can be enhanced by providing exhaust stems from the pressure chamber and/or the back and palm bladders which are remotely located from the stems in direct communication with the flexure control and pressurizing control valves. In a fluid circulating system (not shown) suitable throttling can be provided at the exhaust stems or in the lines from those stems to enable the desired pressures to be developed in the circulating fluid.

Figure 9:
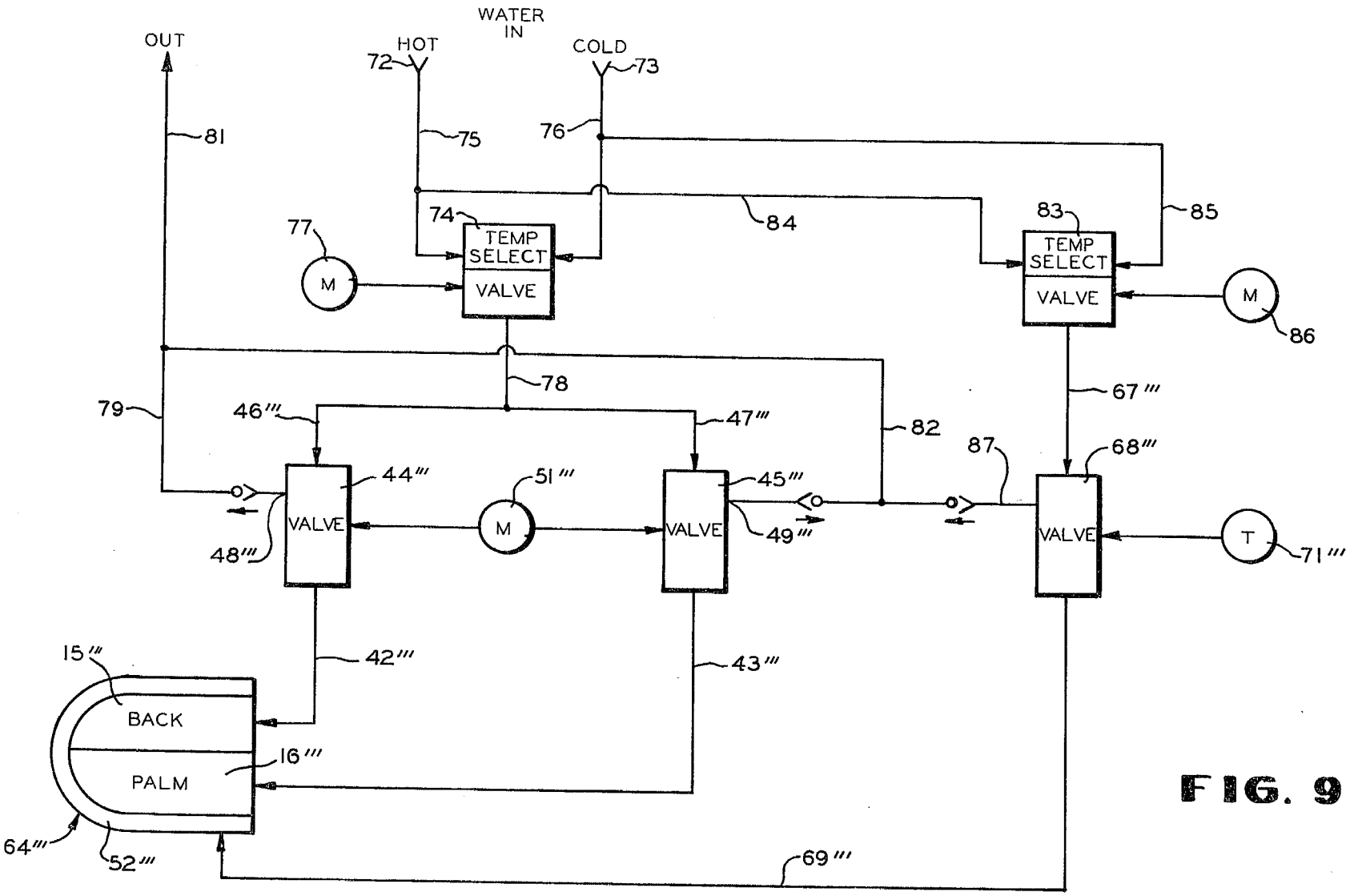
FIG. 9 is a schematic diagram of a hydraulic system for actuating the flexure elements of a hand mit on a cyclic basis, and for applying pressure to the enclosed body portion at a controlled time cycle and a controlled temperature.

In FIG. 9, many of the elements correspond to those shown in previously discussed embodiments and, therefore, like elements will be designated by like reference characters bearing triple primes.

Appliance 64''' is fed fluid from bladder pressurizing sections and chamber pressurizing sections in the general scheme of FIG. 8. The illustrated system includes thermal control of the fluid and contemplates use of a liquid as the fluid. Therefore, a temperature control and an exhaust system is provided for each section. Tap water is a suitable liquid and can be blended from hot and cold taps 72 and 73. When it is spent, it can be exhausted to a suitable drain 81. However, a closed system can be employed where the liquid is returned to a reservoir and either a blending temperature control or an external heating or cooling means is applied through a heat exchanger for temperature control of the liquid fed to the appliance (all not shown).

Hot and cold water are supplied to a temperature controlling blending valve 74 for the flexure control system by means of cold water supply conduit 76 from cold water tap 73. Temperature control blending valve 74 is controlled by a motor 77 responsive to a temperature sensor (not shown) which can be in the supply output conduit 78 or in the bladders 15''' or 16''' and may be arranged to be manually adjusted so that it blends hot and cold water to provide water to conduit 78 of a temperature which establishes the desired temeprature in the bladders.

The temperature controlled water in supply output conduit 78 corresponds to supply 41'' of FIG. 8 and is coupled to back bladder supply conduit 46''' and palm bladder supply conduit 47''' with a pressure regulator (not shown) in conduit 78, if desired. Valve 44''' controls the back bladder water supply to feed through output conduit 42''' to bladder 15''' and to exhaust the water through 48''' to exhaust conduit 79 and drain 81. The palm bladder water supply is controlled by valve 45''' to feed through output conduit 43''' to bladder 16''' and to exhaust the water through 49''' to exhaust conduit 82 and drain 81. A timer 51''' controls the valves to control the flexure cycle of the treatment.

Chamber 52''' has its temperature controlled to apply that temperature to the entire area of treatment by virtue of its encompassing that area. Temperature control is afforded by a temperature control blending valve 83 supplied by a hot water conduit 84 from hot water tap 72 and a cold water conduit 85 from cold water tap 73. Valve 83 is controlled by motor 86 to pass it to pressurizing supply conduit 67''' to pressurizing control valve 68'''. Temperature can be sensed at the output of valve 83, at the appliance as by a thermocouple in chamber 52''' (not shown) or at any other convenient location at which water temperature can be correlated to the treatment temperature desired at the appliance.

Control of the application of pressure and a thermal treatment to the appliance 64''' is by valve 68''' through the medium of timer 71''' as discussed. Output line 69''' conducts the water to and from chamber 52''' in response to the setting of valve 68'''. In the "fill" setting valve 68''' couples supply conduit 67''' to output conduit 69''' and in the "empty" setting valve 68''' couples output conduit 69''' to exhaust 87 coupled to exhaust conduit 82 and, thence, to drain 81.

A segmenting structure for the bladders is shown in FIG. 10. It comprises a pair of folded, flexible sheet hinge members 91 and 92 having a length less than the internal width of the bladder and cemented to the interior walls of the bladder at their tab ends. A hinge is formed between the members 91 and 92 by a line of stitching 93 extending along their length and generally centered transverse of the members. This hinge provides flexibility in the motion of the bladder while maintaining the opposed bladder panels together in the region of attachment of the tabs to form the compartments or segments which function in the appliance driving movements. Thus member 91 has a tab 94 cemented at 95 to the interior surface of panel 18 for back bladder 15 of the embodiment of FIGS. 1–5 and a tab 96 cemented at 97 to the interior surface of panel 19 of bladder 15 in a region which when the bladder is empty is in general registry with the area 95. Member 92 has tabs 98 and 99 cemented at regions 101 and 102 spaced slightly from regions 95 and 97 respectively. Thus, as shown in the fragmentary sectional view of FIG. 10, when the bladder 15 is filled and its panels 18 and 19 separated, those regions of the panels bonded to the tabs are held proximate each other to form the segments of the bladder which by expanding against each other develop the bending moment in the appliance.

Figure 11:
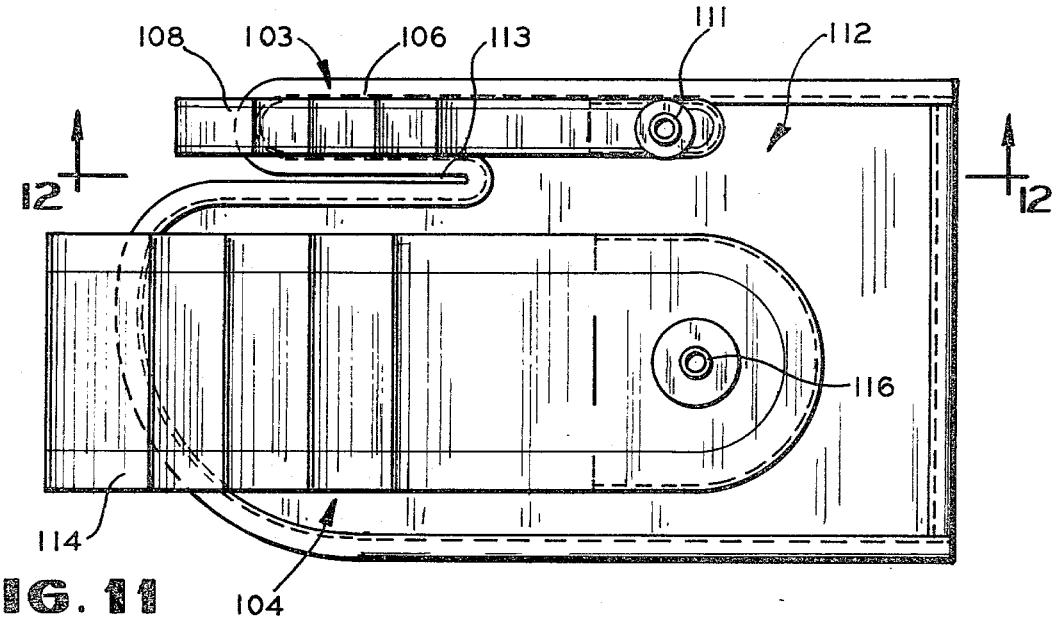
FIG. 11 is a plan view of the back of a hand exerciser appliance having an individual finger flexing section which cooperates with a flexing station for a group of fingers.
Figure 12:
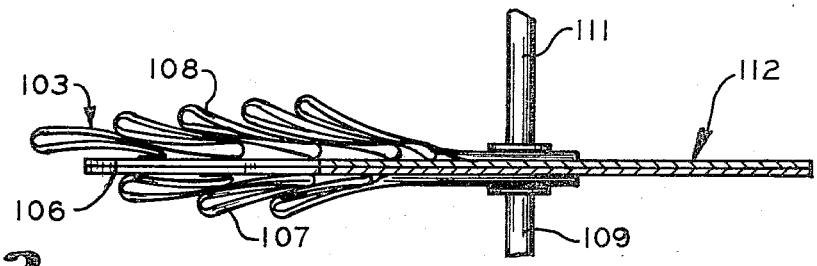
FIG. 12 is a sectional elevational view of the appliance of FIG. 11, taken along the line 12—12.
Figure 13:
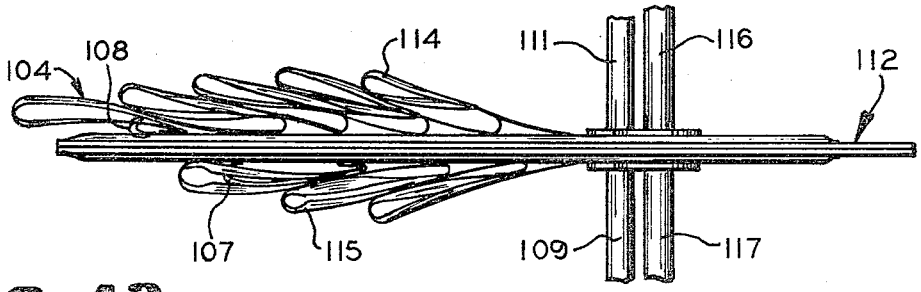
FIG. 13 is a side elevational view of the appliance of FIG. 11.

FIGS. 11, 12 and 13 illustrate another form of a hand exerciser in which a digit can be flexed separately from the flexing of the other digits of the hand. Considering the construction of the drawings for a right hand, the back of the mit shown in FIG. 11 has a fluid actuated compression flexing system for the fifth finger 103 which is separate from the system 104 for the remaining digits. System 103 includes a pocket 106 for receiving the fifth finger and front and back bladders 107 and 108 with their respective stems 109 and 111. FIG. 12 illustrates in side elevation the bladders for system 103.

Finger pocket 106 is physically separate from the main body of mit 112 along the slit 113 and integral with the main body at its base. The bladders for the main body can be of a form as illustrated for FIGS. 1–5 and/or 10 to include a back bladder 114 and a palm bladder 115 with stems 116 and 117.

Each of systems 103 and 104 can be operated independently from fluid supply systems which can flex the systems individually, in a desired time relationship, or simultaneously. Typically a fluid pressure system of the basic structure of that shown in FIG. 7 can be coupled to each of the appliance systems such that one set of valves, timer and conduits control the sequence of the application of pressure to the bladders 107 and 108 of the individual digit flexing system 103 while another set of valves, timer and conduits control the pressure applied to the bladders 114 and 115 of main flexing system 104 (not shown).

It is to be appreciated that the present invention lends itself to many variants utilizing the features of flexure control by the distension of the adjacent walls of a convoluted bladder secured to a flexible yet inextensible member secured to an animal body portion on opposite sides of a joint to develop compressive forces between those walls and at the regions of securement of the convolutions to the envelope to impose a bending moment on that joint. For example, the mit of the illustrative embodiment is such a member which can be provided with a thumb or one or more finger receptacles or envelopes with convoluted bladders on opposite sides such that the thumb or finger within such envelope can be flexed, either individually, or in conjunction with the flexure treatment of the hand and/or wrist. Further, the principles of operation of the illustrated mit can be applied to other forms of appliances including a flexible member secured as by straps on the side of the joint on which a bending moment is to be imposed as on an envelope for body portions on one or both faces of a joint to be flexed, coupled with single bladder or paired bladders on opposite sides of the member or envelope of greater length than the span of the region on which they operate. The bladder, or bladders are secured to the member or envelope at spaced regions along the length of the respective bladders and the length of the member or envelope to form a plurality of convolutions. An example of such a structure is a knee or elbow flexing appliance having a tubular form embracing the leg or arm on each side of the joint and arranged to have a convoluted bladder on the exterior of the joint for flexing it when it is filled with a fluid under pressure, and a convoluted bladder on the interior of the joint for straightening it when it is filled with a fluid under pressure. As in the case of the mit, the inner bladder should be arranged to impose a more limited moment on the joint toward its straightened condition than is imposed by the outer bladder. Various pressure and temperature control systems can be coupled to the appliance. The controls can be fixed or adjustable for a predetermined treatment cycle of flexure, pressure, and/or temperature. Thus, the above description and the accompanying drawings are to be read as illustrative of the invention, and not in a restrictive sense.

What is claimed is:

1. A therapeutic appliance for flexing an animal body joint comprising a flexible and non-extensible member for positioning on portions of the animal body in overlying relationship to the joint; means securing said member to portions of the animal body on each side of the joint; a plurality of chambers of fluid impervious flexible material having proximate side walls, said chambers being mounted on the side of said member spaced from the underlying body portion and secured at said proximate side walls to said member at points on opposite sides of the joint, said chambers having a wall of greater length between said points which are adjacent than the spacing of said points on said member; and means to admit pressurized fluid to said chambers.

2. A therapeutic appliance according to claim 1 wherein said chambers have a length between said points which is at least twice the spacing of said points on said member.

3. A therapeutic appliance according to claim 1 wherein said chambers are in fluid communication with each other.

4. A therapeutic appliance according to claim 1 wherein said member and said securing means are a tube for receiving the body member and joint.

5. A therapeutic appliance according to claim 1 including a second flexible and non-extensible member for positioning on the portions of the animal body opposite said first mentioned member in a region substantially coextensive with the overlying portion of said first mentioned member; second securing means securing said second member to portions of the animal body on each side of the joint; a plurality of second chambers of fluid impervious flexible material having proximate side walls, said chambers being mounted on the side of said second member spaced from the underlying body portion and secured at said proximate side walls to said member at second points on opposite sides of the joint, said second chambers having a wall of greater length between said second points than the spacing of said second points on said second member; and second means to admit pressurized fluid to said second chambers.

6. A therapeutic appliance according to claim 5 wherein said first and second chambers have lengths between said respective points at which they are secured which are at least twice the spacing of said respective points on said respective members to which they are secured.

7. A therapeutic appliance according to claim 5 wherein said second chambers are in fluid communication with each other.

8. A therapeutic appliance according to claim 5 wherein said first mentioned securing means and said second securing means are common to said first mentioned member and said second member.

9. A therapeutic appliance according to claim 8 wherein said first mentioned member, said second member and said securing means are a tube for receiving the body member and joint.

10. A therapeutic appliance for flexing an animal body joint comprising a flexible and non-extensible member for positioning on portions of the animal body in overlying relationship to the joint; means securing said member to portions of the animal body on each side of said joint, a plurality of fluid tight chambers of flexible material secured on said member on the side of said member spaced from the underlying animal body portion, said chambers having adjacent walls which, when filled with fluid under pressure, are pressed upon each other to impart a bending moment to said member; and means to admit fluid under pressure to said chambers.

11. A therapeutic appliance according to claim 10 wherein said plurality of chambers are a single bladder of length greater than the spacing of the points on said member at which said chambers are secured.

12. A therapeutic appliance according to claim 11 wherein said member is the back of a hand mit for receiving a hand, said bladder is at least twice the length of the flexing portion of said mit, said bladder has two opposed flat panel faces and overlying marginal seams, and said bladder is secured to said mit back at transversely aligned paired points of said marginal seams near the opposite lateral sides of said mit back to maintain said bladder in a plurality of sinuous convolutions.

13. A therapeutic appliance according to claim 11 wherein said bladder is secured along said member to form a plurality of bladder convolutions extending from said member.

14. A therapeutic appliance according to claim 1 wherein said non-extensible member is arranged to be positioned on the human hand and including a digit flexing member positioned adjacent and secured to said non-extensible member for positioning on a digit in overlying relationship to a joint thereof; a digit securing means for said digit flexing member securing said member to said digit on each side of the joint; a plurality of digit flexing chambers of fluid impervious, flexible material having proximate side walls, said chambers being mounted on the side of said digit flexing member spaced from the digit and secured at said proximate side walls to said digit at points on opposite sides of the joint, said digit flexing chambers having a wall of greater length between said points which are adjacent than the spacing of said points on said digit flexing member; and means to admit fluid to said digit flexing chambers.

15. A therapeutic appliance according to claim 1 including a fluid tight housing of a volume sufficient to permit the flexing motion of said member and said chambers when filled with fluid enclosing said member, said securing means and said plurality of chambers of flexible material; said enclosing housing having an aperture to admit the portion of the animal body to be flexed; and means to admit fluid to said fluid tight housing.

16. A therapeutic appliance according to claim 1 wherein said member, and said plurality of chambers include superposed transparent portions whereby said body portion under treatment can be visually inspected during treatment.

17. A therapeutic applicance according to claim 5 wherein said first mentioned member and chambers are located on the outside of the joint and the second member and chambers are on the inside of said joint; said first mentioned chambers having a greater length than said second chambers.

18. A therapeutic appliance according to claim 5 wherein said first mentioned member and said second member are a hand mit having a palm side and a back-of-the-hand side and wherein said first mentioned chambers are secured to said back-of-the-hand side and said second chambers are secured on said palm side; said first mentioned chambers having a greater length than said second chambers.

19. A therapeutic appliance according to claim 17 wherein said first mentioned chambers are formed from a single segmented bladder of length greater than the spacing of the points on said first mentioned member at which said chambers are secured and forming a first number of convolutions standing away from said first mentioned member; and wherein said second chambers are formed from a single segmented bladder of length greater than the spacing of the points on said second member at which said chambers are secured and forming a second number of convolutions standing away from said second member.

20. A therapeutic appliance according to claim 19 wherein said second number of convolutions is less than said first number of convolutions.

21. A therapeutic appliance according to claim 19 wherein said first mentioned member and said second member are a hand mit having a palm side and a back-of-the-hand side and wherein said palm side has three bladder convolutions and said back-of-the-hand side has five bladder convolutions.

* * * * *